US005594988A

United States Patent [19]

Fishman

[11] Patent Number: 5,594,988

[45] Date of Patent: Jan. 21, 1997

[54] METHOD OF MAKING A WHEEL RIM

[76] Inventor: Jordan S. Fishman, 4015 Flamingo Ave., Sarasota, Fla. 34242

[21] Appl. No.: 532,702

[22] PCT Filed: Mar. 21, 1994

[86] PCT No.: PCT/GB94/00573

§ 371 Date: Sep. 26, 1995

§ 102(e) Date: Sep. 26, 1995

[87] PCT Pub. No.: WO94/22615

PCT Pub. Date: Oct. 13, 1994

[30] Foreign Application Priority Data

Mar. 30, 1993 [GB] United Kingdom ..... 9306550

[51] Int. Cl.[6] ..... B21K 1/38; B21D 37/16

[52] U.S. Cl. ..... 29/894.353; 29/894.354; 72/342.1

[58] Field of Search ..... 29/894.35, 894.351, 29/894.352, 894.353, 894.354; 301/63.1, 95–98; 72/342.1

[56] References Cited

U.S. PATENT DOCUMENTS

| | | | |
|---|---|---|---|
| 1,760,560 | 5/1930 | Kranz et al. . | |
| 2,944,502 | 6/1960 | Lemmerz . | |
| 3,438,111 | 4/1969 | Wilcox . | |
| 4,397,345 | 8/1983 | Ramaranam et al. | 29/894.352 |

FOREIGN PATENT DOCUMENTS

| | | | |
|---|---|---|---|
| 2158052 | 6/1973 | France . | |
| 2242171 | 3/1975 | France . | |
| 2317028 | 2/1977 | France . | |
| 2437256 | 4/1980 | France . | |
| 745467 | 2/1956 | United Kingdom | 29/894.351 |

*Primary Examiner*—P. W. Echols
*Attorney, Agent, or Firm*—Mark D. Perdue; Robert A. Felsman

[57] ABSTRACT

A method of manufacturing a wheel rim comprising the steps of: (i) pressing or rolling flat steel section into an annulus; (ii) welding the ends of the section together; (iii) heating to about 700° C. one end of the annulus to an axially extending depth of about 7.5 cm; (iv) pressing said one end partially or fully to shape; (v) heating to about 700° C. the other end of the annulus to an axially extending depth of about 7.5 cm; (vi) pressing said other end partially or fully to shape.

14 Claims, 3 Drawing Sheets

METHOD OF MAKING A WHEEL RIM

This invention concerns a wheel rim and more particularly a method of manufacturing same.

Normal practice is to cold press a wheel rim from a length of stainless steel tube or roll a special mill section into an annulus whose ends are welded together to form a tube. Where full advance rings, side rings, and lock rings are required, they are formed from purpose-rolled sections. This is costly and requires massive pressing machines. Rim manufacture has accordingly been confined to major industrial nations.

It is an object of the present invention to provide a more economic manufacturing technique to enable rim manufacture to be commenced with relatively inexpensive capital equipment enabling short runs in a wide range of sizes to be produced economically.

According to the present invention there is provided a method of manufacturing a wheel rim comprising the steps of:

(i) pressing or rolling a standard flat section into an annulus;
(ii) welding the ends of the section together;
(iii) heating to about 700° C. one end of the annulus to an axially extending depth of about 7.5 cm;
(iv) pressing said one end partially or fully to shape;
(v) heating to about 700° C. the other end of the annulus to an axially extending depth of about 7.5 cm;
(vi) pressing said other end partially or fully to shape.

The method may include when required the further step of:

(vii) pressing the rim to its final shape, having first heated to about 700° C. any portion thereof to be formed or further formed.

Steps (iv) and (vi) may be effected by press tools which move to engage the rim in an axial direction whilst step (vii) may be effected by press tools which move to engage the rim in a radial direction.

The movable tools used in step (vii) may be driven by an axially moving member engaging the tools at complementary wedge surfaces to give mechanical advantage.

The rim may be provided with full advance, side and lock rings and be adapted to receive a tire having an inner tube, or the rim may be of one piece and adapted to receive either a tire having an inner tube or a tubeless tire.

Any full advance, side or lock rings required may be fabricated from standard flat sections by machining same to the required cross-sectional size and shape.

The invention will be further apparent from the following description, with reference to the several figures of the accompanying drawing, which show by way of example only the production of one form of wheel rim in accordance with the method thereof.

Figure 1:
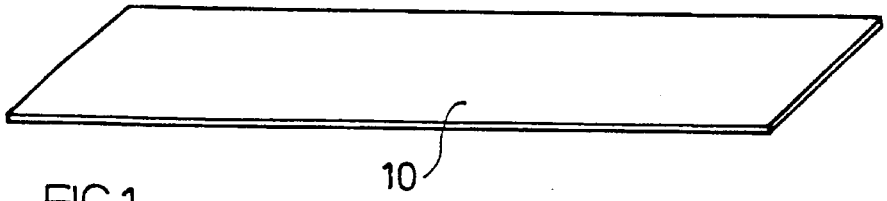
FIG. 1–11 show sequential stages in the production.
Figure 2:
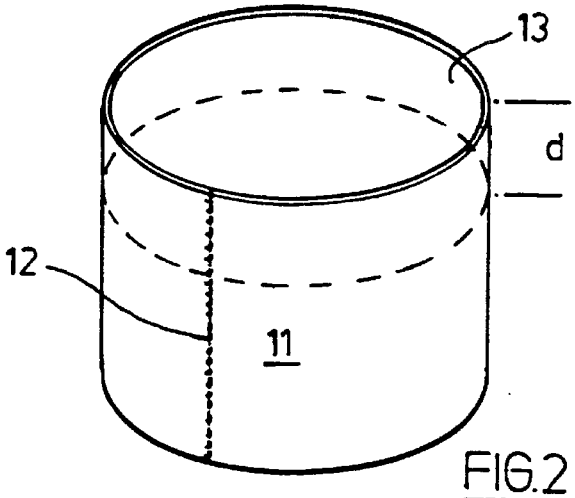

Referring now to the drawings it will be seen that a standard flat steel section 10 (FIG. 1) is first pressed or rolled to form an annulus 11 which is secured by welding the ends of the section 10 together as indicated at 12 (FIG. 2).

Figure 3:
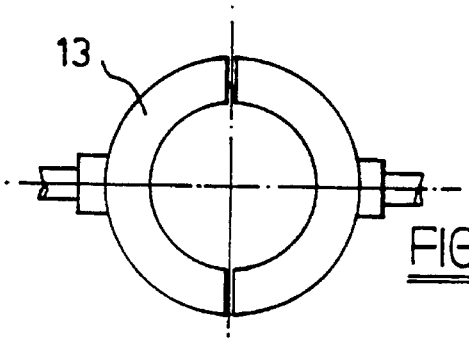
Figure 4:
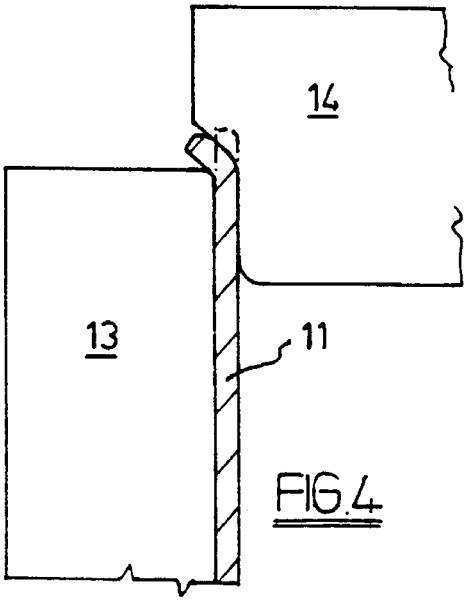
Figure 5:
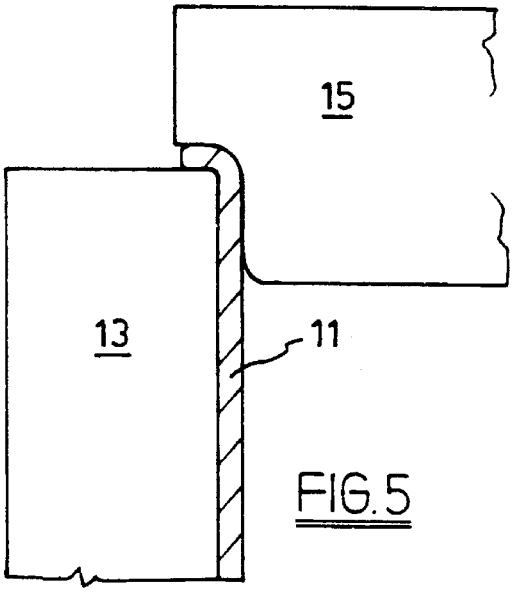

A band 13 having an axial depth d of about 7.5 cm at one end of the annulus 11 is heated to about 700° C. and pressed partially to shape. This is effected by surrounding the annulus 11 by a split die 13 (FIG. 3) and engaging the upper end of the annulus sequentially with axially movable first and second press tools 14 (FIG. 4) and 15 (FIG. 5) respectively. As illustrated in FIGS. 4 and 5, the pressing operation occurs without any flow of metal which would change the thickness of the steel section.

Figure 6:
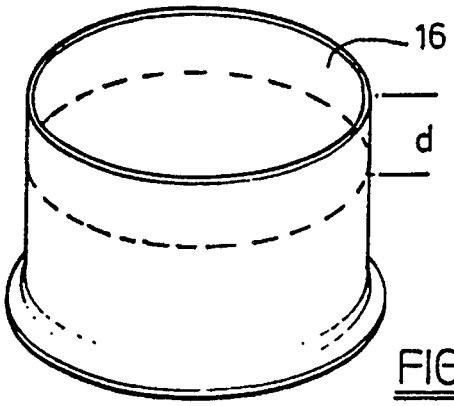
Figure 7:
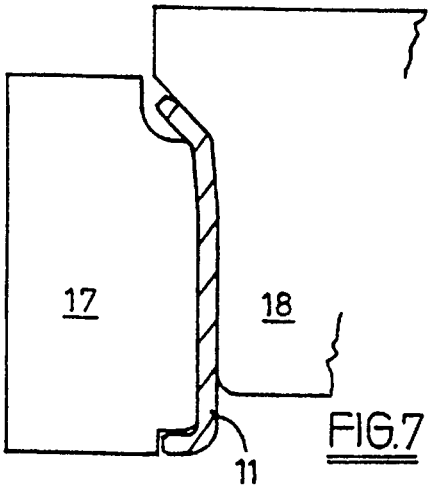
Figure 8:
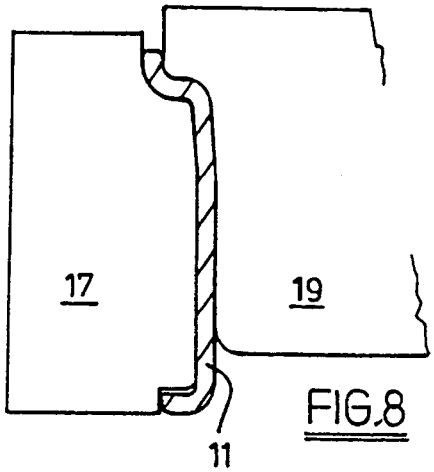

The annulus 11 is removed from the die 13 and inverted (FIG. 6). A band 16 having an axial depth d of about 7.5 cm at the now upper end of the annulus 11 is heated to about 700° C. and pressed to shape. This is effected by surrounding the annulus with a further split die 17 and engaging its upper end sequentially with axially movable third and fourth press tools 18 and 19 (FIGS. 7 and 8) respectively. As illustrated in FIGS. 7 and 8, the pressing operation occurs without any flow of metal which would change the thickness of the steel section.

Figure 9:
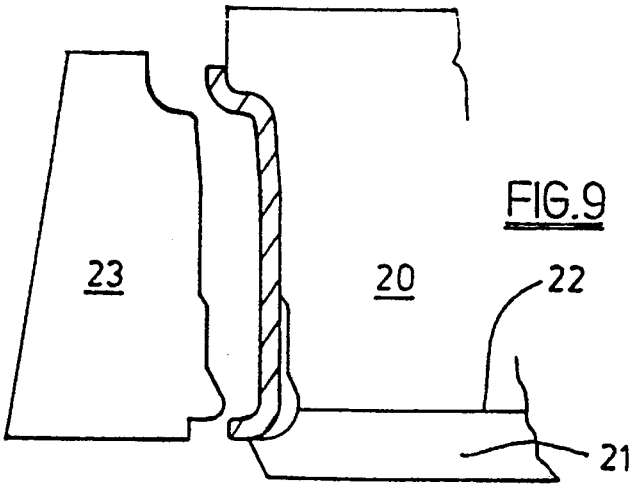
Figure 10:
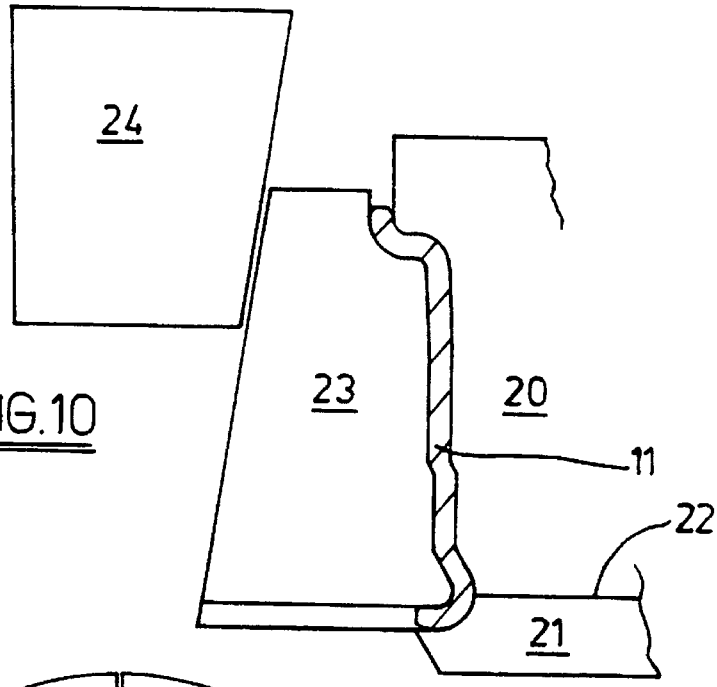
Figure 11:
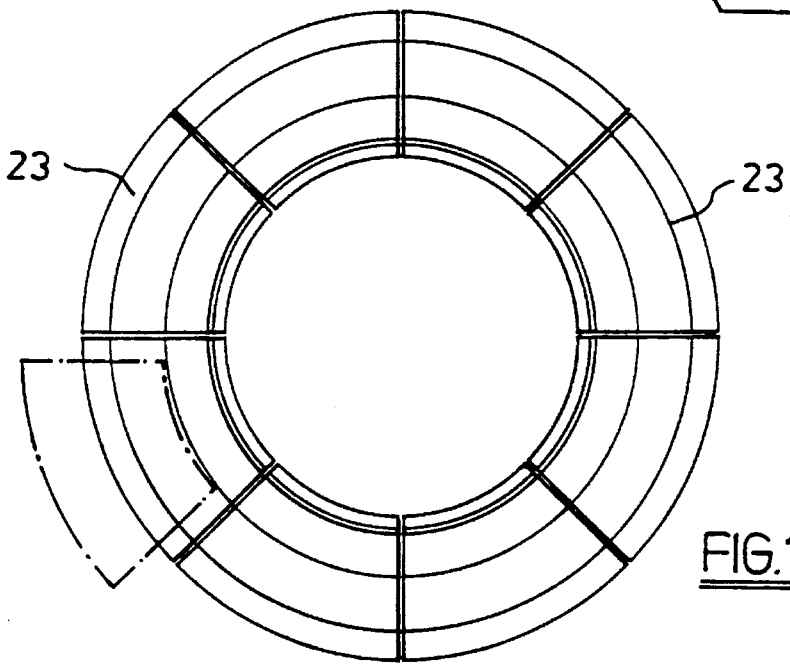

Finally the annulus 11 is fitted over an inner die having upper and lower sections 20 and 21 separable at the plane 22 (FIG. 9) and pressed to its final shape (FIG. 10) by a press tool comprised by eight segments 23 (FIG. 11) which are driven radially against the outer periphery of the annulus 11 by an axially movable member 24 which engages the segments 23 at complementary wedge surfaces to give mechanical advantage.

Figure 12:
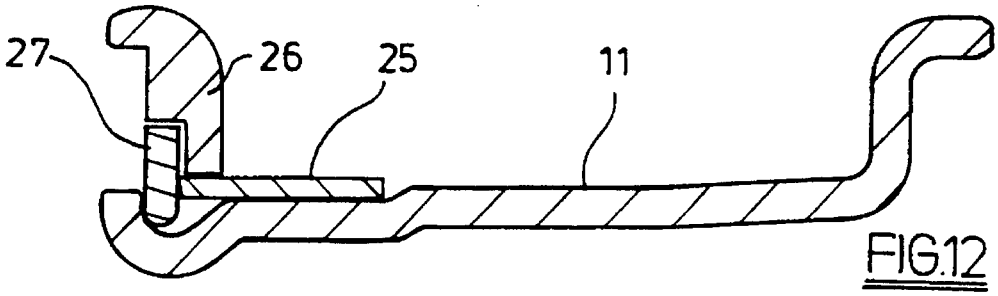
FIG. 12 shows a cross-section through the completed rim.

The completed rim is removed from the die and has the cross-section shown in FIG. 12.

The full advance ring 25, side ring 26 and stop ring 27 are fabricated from lengths of standard flat section which are machined to give the required ring sections.

It will be appreciated that it is not intended to limit the invention to the above example only, many variations, such as might readily occur to one skilled in the art, being possible, without departing from the scope thereof.

Thus for example a rim of different cross-sectional shape and adapted for example to receive a tubeless tire may be produced by heating and pressing its opposite ends in turn. In effect the operations of FIGS. 1, 2, 3 and those of FIGS. 7 and 8 on each side of the annulus would be performed, those of FIGS. 4, 5, 9 and 10 being unnecessary.

I claim:

1. A method of manufacturing a wheel rim comprising the steps of:

forming a flat steel section into an annulus;

welding the ends of the section together;

heating to about 700° C. one end of the annulus to an axially extending depth of about 7.5 cm;

pressing said one end to shape by bending the end without any flow of metal which would change the thickness of the section;

heating to about 700° C. the other end of the annulus to an axially extending depth of about 7.5 cm;

pressing said other end to shape by bending the end without any flow of metal which would change the thickness of the section.

2. A method according to claim 1 including the further step of:

pressing the rim to its final shape, having first heated to about 700° C. any portion thereof to be formed or further formed, by bending without any flow of metal which would change the thickness of the section.

3. A method according to claim 1 or claim 2 wherein the steps of forming the ends are effected by press tools which move to engage the rim in an axial direction.

4. A method according to claim 2 wherein the step of pressing the rim to its final shape is effected by press tools which move to engage the rim in a radial direction.

5. A method according to claim 4 wherein the radially movable press tools are driven by an axially moving member engaging the tools at complementary wedge surfaces to give mechanical advantage.

6. A method according to claim 1 wherein the step of forming the annulus is accomplished by pressing.

7. A method according to claim 1 wherein the step of forming the annulus is accomplished by rolling.

8. A method of manufacturing a wheel rim comprising the steps of:

forming a flat steel section into an annulus; welding the ends of the section together;

heating to about 700° C. one end of the annulus to an axially extending depth of about 7.5 cm;

pressing said one end fully to shape by bending the end without any flow of metal which would change the thickness of the section;

heating to about 700° C. the other end of the annulus to an axially extending depth of about 7.5 cm;

pressing said other end fully to shape by bending the end without any flow of metal which would change the thickness of the section.

9. A method according to claim 8 including the further step of:

pressing the rim to its final shape, having first heated to about 700° C. any portion thereof to be formed or further formed, by bending without any flow of metal which would change the thickness of the section.

10. A method according to claim 8 wherein the steps of pressing the ends are effected by press tools which move to engage the rim in an axial direction.

11. A method according to claim 9 wherein the step of pressing the rim to its final shape is effected by press tools which move to engage the rim in a radial direction.

12. A method according to claim 11 wherein the radially movable press tools are driven by an axially moving member engaging the tools at complementary wedge surfaces to give mechanical advantage.

13. A method according to claim 8, wherein the step of forming the annulus is accomplished by pressing.

14. A method according to claim 8, wherein the step of forming the annulus is accomplished by rolling.

* * * * *